US006558488B2

(12) United States Patent
Wanninger et al.

(10) Patent No.: US 6,558,488 B2
(45) Date of Patent: May 6, 2003

(54) METHOD OF MAKING POURABLE PLASTIC-BOUND EXPLOSIVE CHARGES OR ROCKET PROPELLANT

(75) Inventors: Paul Wanninger, Hermannsburg (DE); Rainer Böhm, Fasserg (DE); Horst Pinkernelle, Unterlüss (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/077,770

(22) Filed: Feb. 20, 2002

(65) Prior Publication Data

US 2003/0056865 A1 Mar. 27, 2003

(30) Foreign Application Priority Data

Feb. 20, 2001 (DE) ..... 101 07 948

(51) Int. Cl.[7] ..... C06B 45/10

(52) U.S. Cl. ..... 149/19.1; 149/19.2; 149/19.93; 149/6; 149/21

(58) Field of Search ..... 149/6, 19.1, 19.2, 149/19.93, 21

(56) References Cited

U.S. PATENT DOCUMENTS 2,647,047 A * 7/1953 Richardson ..... 149/6
RE27,025 E * 1/1971 McDonald ..... 149/6
4,115,165 A * 9/1978 Machacek ..... 149/5
4,116,734 A * 9/1978 Perrault et al. ..... 149/19.2
4,376,083 A * 3/1983 Ulsteen ..... 149/19.93
4,641,581 A * 2/1987 Weickert et al. ..... 102/307
4,689,250 A * 8/1987 Quella et al. ..... 427/216
5,026,443 A * 6/1991 Muller et al. ..... 149/21
5,123,981 A * 6/1992 Mullay et al. ..... 149/6
5,445,886 A * 8/1995 Ogawa ..... 428/405
5,451,277 A * 9/1995 Katzakian et al. ..... 149/6
5,547,526 A * 8/1996 Wanninger et al. ..... 149/19.2

* cited by examiner

*Primary Examiner*—Edward A. Miller
(74) *Attorney, Agent, or Firm*—Marina V. Schneller; Venable, Baetjer, Howard & Civiletti, LLP

(57) ABSTRACT

The invention relates to a method of making pourable, plastic-bound explosive charges or rocket propellants, to which a metal powder having essentially spherically shaped grains is added.

To avoid an increase in the viscosity of the explosive charge or the rocket propellant through polar groups attached to the surface of the metal powder, it is suggested according to the invention that the polar groups of the metal powder be saturated with $SiR_3$ groups (Si=silane; R=organic residue) before the metal powder is added to the explosive mixture. As a result, the polar groups can no longer react with the isocyanates of the explosive charge or the rocket propellant and the specific surface of the respective metal powder, as well as the viscosity of the charges, is reduced.

12 Claims, No Drawings

METHOD OF MAKING POURABLE PLASTIC-BOUND EXPLOSIVE CHARGES OR ROCKET PROPELLANT

FIELD OF THE INVENTION

The invention relates to a method of making pourable, plastic-bound explosive charges or rocket propellants.

BACKGROUND OF THE INVENTION

Plastic-bound explosive charges have a relatively high insensitivity despite having a high effective power. They are composed of reactive polymers with an explosive material or an admixture of explosive materials; the explosive material can be octogen, hexogen, pentaerythritol tetranitrate. Mixtures of the polymer and explosive material is undertaken prior to curing. The proportion of polymers is approximately 10 to 20 weight %.

One problem when making plastic-bound explosive charges is that if the solid substance content increases, meaning as the proportion of explosive material increases, the viscosity of the mixture can increase to such a degree that the mixture is no longer pourable. The theoretical limit of explosive material content in plastic-bound explosive charges which have a viscosity low enough to be pourable differs from the actual or empirical explosive material content in plastic bound explosive charges which are, in fact, pourable. Theoretically, the limit for a pourable mixture is at 92 weight %, but in practice the limit for a pourable mixture has turned out to be approximately 90 weight %. In addition, explosive charges having such a high solid substance content can be poured only if the crystal grain sizes for the explosive substance used for the explosive charge are within a predetermined diameter range. Thus, a relatively cost-intensive screening of grain fractions is required.

In a previously unpublished patent application, applicant proposed adding 0.1 to 10 weight % of extremely fine-grained vanadium, niobium, tantalum, chromium, molybdenum or tungsten powder or a mixture of two or more of these powders to the respective explosive charge. The powder grains should have an essentially spherical shape. When using these metal powders, which have a very small specific surface owing to the spherical shape of the powder grains, it has surprisingly turned out that they act like liquid lubricants between the rough-grained explosive substance particles (tribological effect), so that a relatively low viscosity results.

Testing by the applicant has shown that when mixing the metal powders into the plastic-bound explosive charges or the rocket propellants, the viscosity reduction is still not at an optimum. This is due to polar groups that frequently attach themselves to the metal powder surface and react with the isocyanates of the plastic-bound explosive charges or the rocket propellants. In turn, this leads to an increase in the viscosity of the respective mixture. The same is true in particular for the OH groups that are attached to the surface as a result of the effect of humidity in the air. However, other polar groups attached to the metal surfaces (e.g. carboxyl groups) can also lead to an increase in the viscosity. In particular, reaction between hydroxyl terminated polybutadiene (HTPB) a diol, together with isocyanate produces polyurethanes. If the polar groups on the surface of the small particles, which have a large specific surface react with isocyanate, an increasing viscosity results. The saturating process decreases the specific surface and cause the lower viscosity.

SUMMARY OF THE INVENTION

It is the object of the invention to provide a method of making insensitive, pourable, plastic-bound explosive charges or rocket propellants with a high (e.g. about 88–90%, and preferably greater than 88%) proportion of solid substance, thereby making it possible to avoid an increase in the viscosity caused by polar groups attached to the metal powder surface.

This object is solved according to the invention with the features listed in claim 1. Additional, particularly advantageous embodiments of the invention are disclosed in the dependent claims.

The invention essentially is based on the idea of saturating (blocking or reacting) the polar groups of the metal powder with —$SiR_3$ groups; in —$SiR_3$, Si is silicon; and R is an organic residue, for example hydrocarbyl, which in turn may be alkyl or aryl of 1 to 20 carbon atoms. Treatment of the metal powder with a source of —$SiR_3$ occurs prior to mixing the metal powder into the explosive mixture. As a result, the polar groups can no longer react with the isocyanates, the specific surface of the respective metal powder is reduced and the viscosity of the explosive charge drops. Alkyl residues and aryl residues are considered for the organic residues; the alkyl residues are more reactive.

It has proven to be particularly advantageous if trimethyl chlorosilane ($Me_3SiCl$) is used for saturating the polar groups on the metal powder. This agent reacts immediately with the OH groups and forms a silyl ether (—0—$SiMe_3$).

DETAILED DESCRIPTION OF AN EMBODIMENT OF THE INVENTION

For one exemplary embodiment, 100 g tungsten powder (grain size between 3 and 5 $\mu$m) were added to a solution of 900 g pentane and 20 g trimethyl chlorosilane and the mixture was stirred for 5 minutes. The tungsten powder was subsequently filtered off and dried in the drying oven. Whereas the specific surface prior to the treatment with $Me_3SiCl$ was 0.1978 $m^2/g$, it was only 01880 $m^2/g$ following the treatment, which consequently led to a reduction in the viscosity of the explosive mixture from approximately 600–800 Pas to approximately 400 Pas.

The explosive charges according to the invention can be produced, for example, with the aid of the following formulations:

| | |
|---|---|
| 80–88 weight % | crystalline explosive substance, e.g. RDX* or HMX** |
| 10–20 weight % | binder, e.g. HTPB*** |
| 5–10 weight % | softener [plasticizer?] |
| 0.01–02 weight % | bonding agent |
| 0.05–05 weight % | pouring aid |
| 0.1–1.0 weight % | antioxidizing agent |
| 0.1–10 weight % | metal powder |

*RDX is cyclotrimethylenetrinitramine
**HMX is Octogen
***HTPB is hydroxylterminatedpolybutadiene The grain size for the respective metal powder should be between 0.1 and 5 $\mu$m (average particle size diameter, measured by sieve or by laser diffraction).

What is claimed is:

1. A method of making pourable, plastic-bound explosive charges or rocket propellants, comprising providing an explosive charge or rocket propellant admixed with a polymer;

providing a metal powder, said powder comprising powder grains with essentially spherical shape, treating the metal powder with a reagent which is reactive with polar groups and provides —$SiR_3$ groups wherein Si is silicon; and R is hydrocarbyl; and after said treating, adding the treated metal powder to said explosive.

2. A method of claim 1, wherein said metal powder contains polar groups prior to said treating.

3. A method of claim 1, wherein the hydrocarbyl is alkyl or aryl.

4. A method of claim 2, wherein said reagent is trimethyl chlorosilane ($Me_3SiCl$) and react with said polar groups.

5. A method of claim 1, wherein said metal powder comprises at least one metal selected from the group consisting of vanadium, niobium, tantalum, chromium, molybdenum or tungsten.

6. A method of claim 1, wherein grain size (measured as average diameter) metal powder ranges from between 0.1 and 5 $\mu$m average.

7. An explosive charge containing compositions, which is pourable comprising particles of metal treated with hydrocarbylchlorosilane, wherein prior to being treated said particles of metal contain functional groups which are reactive to hydrocarbylchlorosilane;

an explosive material in the form of grains, and organic polymer containing functional groups which are reactive with polar groups on said metal prior to being treated with said hydrocarbylchlorosilane.

8. The explosive charge of claim 7, wherein the metal is selected from the group consisting of vanadium, niobium, tantalum, chromium, molybdenum or tungsten.

9. The explosive charge of claim 8, wherein the hydrocarbylchlorosilane is trimethylchlorosilane.

10. A pourable, plastic-bound rocket propellant, comprising particles of metal treated with hydrocarbylchlorosilane, wherein prior to being treated said particles of metal contain functional groups which are reactive to hydrocarbylchlorosilane;

an explosive material in the form of grains, and organic polymer containing functional groups which are reactive with polar groups on said metal prior to being treated with said hydrocarbylchlorosilane.

11. The rocket propellant of claim 10, wherein the metal is selected from the group consisting of vanadium, niobium, tantalum, chromium, molybdenum or tungsten.

12. The explosive charge of claim 10, wherein the hydrocarbylchlorosilane is trimethylchlorosilane.

* * * * *